US012121172B2

(12) United States Patent
Taylor

(10) Patent No.: US 12,121,172 B2
(45) Date of Patent: Oct. 22, 2024

(54) GARMENT REMOVING TOOL

(71) Applicant: Tannian Innovations Limited, Ennis (IE)

(72) Inventor: Laura Jean Taylor, Gort (IE)

(73) Assignee: Tannian Innovations Limited, Ennis (IE)

( * ) Notice: Subject to any disclaimer, the term of this patent is extended or adjusted under 35 U.S.C. 154(b) by 0 days.

(21) Appl. No.: 15/487,120

(22) Filed: Apr. 13, 2017

(65) Prior Publication Data

US 2017/0295976 A1 Oct. 19, 2017

(30) Foreign Application Priority Data

Apr. 15, 2016 (GB) ..... 1606603

(51) Int. Cl.
*A47G 25/90* (2006.01)

(52) U.S. Cl.
CPC ..... *A47G 25/908* (2013.01)

(58) Field of Classification Search
CPC .... A47G 25/90; A47G 25/901; A47G 25/902; A47G 25/905; A47G 25/908
USPC ..... 223/111, 113, 118, 119
See application file for complete search history.

(56) References Cited

U.S. PATENT DOCUMENTS 594,894 A * 12/1897 Nylander ..... A47G 25/82 223/118
2,939,618 A * 6/1960 Mangels ..... A47G 25/80 223/113
3,410,463 A * 11/1968 Carlos ..... A47G 25/82 223/119
3,436,000 A * 4/1969 Batista ..... A47G 25/82 223/118
3,501,073 A * 3/1970 Breithor ..... A47G 25/82 223/118
4,620,737 A * 11/1986 Sanger ..... A47G 25/905 223/111
4,709,839 A * 12/1987 Tucker ..... A47G 25/82 223/119
4,943,097 A * 7/1990 Sanger ..... A47G 25/908 223/111
6,283,342 B1 * 9/2001 Wilkerson ..... A47G 25/905 223/111
6,698,630 B1 * 3/2004 Maguire ..... A47G 25/82 223/113
6,763,982 B1 * 7/2004 Livornese ..... A47G 25/82 223/111
9,144,339 B2 * 9/2015 Cannata ..... A47G 25/82
9,386,875 B2 * 7/2016 Clifton ..... A47G 25/82
2002/0139819 A1 * 10/2002 Ferraioli ..... A47G 25/908 223/111

(Continued)

FOREIGN PATENT DOCUMENTS

HK 2221604 A * 2/1990 ..... A47G 25/82
WO WO 2005009185 A1 * 2/2005 ..... A47G 25/905
WO WO-2014114799 A1 * 7/2014 ..... A47G 25/90

*Primary Examiner* — Nathan E Durham
(74) *Attorney, Agent, or Firm* — QuickPatents; Kevin Prince

(57) ABSTRACT

The invention relates to a tool for assisting in the removal of clothing. In particular, the invention relates to a tool which can be used to help remove socks, stockings, leggings, compression stockings, wetsuits, dry suits and the like, which can be difficult to remove from the lower leg and foot.

20 Claims, 2 Drawing Sheets

(56) References Cited

U.S. PATENT DOCUMENTS

| | | | | |
|---|---|---|---|---|
| 2011/0042425 | A1* | 2/2011 | Norris | A47G 25/905 223/112 |
| 2012/0211532 | A1* | 8/2012 | Santos | A47G 25/82 223/118 |
| 2012/0228343 | A1* | 9/2012 | Brobeg | A47G 25/905 223/111 |
| 2014/0151412 | A1* | 6/2014 | Cohen | A47G 25/905 223/111 |
| 2014/0263486 | A1* | 9/2014 | Taylor | A47G 25/905 223/111 |

* cited by examiner

GARMENT REMOVING TOOL

PRIORITY CLAIM AND INCORPORATION BY REFERENCE

This application is filed pursuant to the Paris Convention and claims priority to United Kingdom patent application number 1606603.7 filed on Apr. 15, 2016, the contents of which are incorporated by reference. All references cited herein are incorporate by reference.

FIELD OF THE INVENTION

The invention relates to a tool for assisting in the removal of clothing. In particular, the invention relates to a tool which can be used to help remove socks, stockings, leggings, compression stockings, wetsuits, dry suits and the like, which can be difficult to remove from the lower leg and foot.

BACKGROUND TO THE INVENTION

Many people find it difficult to remove items of clothing, such as socks, stockings or tights either because they are elderly and infirm, or because people with arthritis or other afflictions of the hands or fingers, find it difficult to grasp the sock or stocking and pull it down the lower leg and around the heel to remove it. As a result they tend to wear loose fitting socks or stockings which are easier to remove and which don't fit as well. Alternatively they need assistance from another person to remove the hosiery. In addition water sports enthusiasts such as surfers, windsurfers, swimmers and scuba divers wear wetsuits or dry suits to allow them to spend longer in the water. Whilst the suit provides thermal insulation, abrasion resistance and buoyancy, wet and dry suits are difficult to remove, particularly if they are wet. In addition cold hands, as a result of spending prolonged periods in the water, also make it difficult to remove the wetsuit. Whilst oils and lubricants can be used to help lubricate the skin to make it easier to remove the suit, such oils and lubricants can often damage the materials from which the suit is made.

Compression stockings are often used by passengers on airline flights, but they are also used for medical conditions such as oedema, phlebitis and thrombosis. They help decrease venous pressure, prevent venous stasis and impairment of venous walls, as well as helping to prevent the formation of blood clots in the lower legs, and aiding in the treatment of ulcers of the lower legs. They are elastic garments in which the elastic is present throughout the garment. Unlike conventional socks or stockings, compression stockings use stronger elastics to create significant pressure on the legs, ankles and feet. However the stronger elastic makes it much more difficult to remove the compression stocking than removing conventional socks or stockings. In addition, wearers often attempt to remove the compression stockings in the confined space of an airline seat, which hampers removal. Also wearers of compression stockings may often have medical conditions which tend to reduce their mobility and their ability to bend, which makes the removal of compression stockings are traditionally difficult.

OBJECT OF THE INVENTION

It is therefore an object of the invention to provide a tool that can be used to assist in the removal of socks, stockings, tights, wet or dry suits. A further aspect of the invention is to provide a tool which can be used to assist in the removal of compression stockings which are a tight fit on the legs. A still further object is to provide a tool which can be used by the elderly, the infirm or those with limited hand movements, or those who have difficulty bending down, to remove socks, stockings, tights or the like.

Wetsuits and dry suits tend to stick to the skin and are particularly difficult to remove from the leg areas. Another object of the invention is therefore to provide a tool which assists in facilitating peeling large areas of the suit from the skin in a short space of time, thus reducing the time and effort required to remove the suit. A further object is to provide a tool which means the user does not have to excessively pull or tug at the suit to remove it, thereby reducing the chance of accidently ripping or weakening the suit fabric through poor removal practice. A still further object is to provide a tool which allows the user to remove the wetsuit from a standing position using only one hand, while the other hand can be used to secure balance. Or the user can sit down on a chair and use tool to remove the wetsuit from the lower leg area.

SUMMARY OF THE INVENTION

According to the present invention there is provided a garment removal tool for facilitating removal of an article of clothing from the lower limbs, ankle and feet of a wearer's body, the tool comprising an elongate body having a longitudinal length and a transverse length, the elongate body having a first end adapted for gripping by a hand, and a second end adapted for insertion between the skin of the wearer and the garment worn by the wearer, wherein the tool surface which abuts the skin of the wearer when the tool is in use, is textured.

Surface roughness, is a component of surface texture. It is quantified by the deviations in the direction of the normal vector a real surface from its ideal form. If these deviations are large, the surface is rough; if they are small, the surface is smooth. By textured we mean that the surface is slightly roughened or stippled. Suitably the textured surface of the tool may have a surface finish with a roughness average of between 12 and 230 Ra micrometres. Ra is the arithmetic average of the roughness profile. As described in ASME B 46.1, Ra is the arithmetic average of the absolute values of the profile height deviations from the mean line, recorded within the evaluation length. Thus Ra is the average of a set of individual measurements of the surface's peaks and valleys.

Preferably the roughness average may be between 20 and 200 Ra, between 50 and 150 Ra or between 75 and 125 Ra.

The surface texture may be achieved by bead blast moulding in which fine abrasive beads are used to create a textured surface on the polymer surface of the tool. Alternatively, partial bead blasting, or use of a tumbler or textured paint can produce a textured surface.

With bead blast moulding the mould for plastic injection is bead blasted which is a very similar process to sand blasting. In part or partial bead blasting the tool is bead is bead blast after moulding. When using a tumbler the part of the tool is placed in a tumbler with a fine aggregate material which abrades the part to give a textured surface. A textured paint could be used to provide the texturing which involves use of a paint which contains particles of varying coarseness.

A highly polished surface tends to stick to the skin. A highly polished surface also can cause a vacuum effect similar to what happens when two smooth surfaces such as glass are put together. The texture on the part helps reduce the part sticking to the skin since it makes less surface contact with the skin and this eases removal of the stocking or wetsuit.

Preferably the elongate body is formed as a tongue and the insertion end of the tongue which abuts the limb and foot of the wearer in use, broadens at its free end into a paddle shape. The tongue is suitably flexible. Suitably the tongue and/or the paddle have a textured surface which abuts the skin in use.

Preferably the paddle is convex on the side that abuts the skin, and concave on the underside that would abut the garment in use. The paddle may be angled below the plane of the tongue and away from the skin of the user in the in use configuration. The angle is suitably in the range 4 to 10 degrees, more suitably 6.5 degrees off the plane. This formation prevents the tongue catching on the heel of the wearer. Suitably the edge of the paddle shape is filleted or rounded to reduce dragging of the garment as it is being removed.

Preferably the underside of the elongate body is provided with a means for maintaining separation of the garment from the limb, the means projecting downwardly from the underside of the elongate body.

The means for maintaining separation may comprise at least one projection extending downwards from the underside of the tool. The projection may be at an angle of less than 120 degrees to the elongate body. Preferably, the projection may be at an angle of less than 90 degrees to the body. The projection itself may be straight or substantially straight, or may have a generally curved or grooved shape for gathering and/or holding back the rolled material of the garment. The projection may have an apex pointing in the general direction of the insertion end of the elongate body. Preferably, at least two such projections are provided and are spaced apart transversely along the transverse length of the end of the elongate body. Preferably, the projection is at least one fin on the elongate body. The projection may be wider at the base connected to the tool, and narrow to a point at the apex/top of the projection.

Other suitable means for maintaining separation of the garment from the skin include at least one projecting arm, hooks, fingers, forks, or combinations thereof, any of which can be used to gather the loosened material and prevent it from re-connecting with the skin. The means for maintaining separation of the garment from the skin functions to gather the garment and assist in peeling it down the leg and gliding over the heel. In order for the wearer to free their leg from the garment they must change foot position from a flat foot to pointer toe position. Once the tool is in the correct position the wearer's heel can press against the insertion end and change position from flat foot to pointed toe position, thus allowing the foot to slip out of the garment.

The elongate body may be formed in a single integral piece or it may be formed in parts, for example, a tongue portion, a paddle portion and a handle portion, which are complementarily designed to fit together. Such fixing together may be reversible (for assisting cleaning) or irreversible, depending on the mode of manufacture.

Suitably, the end of the elongate body adapted for gripping comprises grooves for gripping by a hand. Desirably, the end of the elongate body which is adapted to be gripped by a hand may further comprise finger grooves, indentations or positioning areas for ensuring a firm and secure grip.

The elongate body may be straight, or substantially straight. However, it is preferred that remover tool has a concave shape, such as a U-shape, or an S-shape, whereby a portion of the elongate body is concave (curved), along the transverse length of the elongate body that is inserted during use. By "concave" is meant concave relative to the underside of the tool i.e. the side remote from the user's skin in use of the tool. This shape is useful as it ensures a comfortable user experience and facilitates insertion of the tool into the area between the skin and the garment.

Suitably, the concave side of the tool is provided with one or more strengthening ribs to increase the bending strength of the tool, so that the tool cannot be easily broken in use. Suitably, the ribs may run perpendicularly along the length of the tongue from the projection to the handle. Additional ribs may be provided which run transverse to the perpendicular ribs. The ribs do not extend beyond the projection so that the paddle end is still flexible.

The paddle end requires this flexibility in order for it to flex to the contours of the user's ankle and heel. The central portion of the tool, between handle and the projection needs to be stiff to prevent bending of this section so that the user can control the position of the paddle end accurately. The paddle end is subjected to a significant amount of flexural load during use, so the ribs help to minimise the risk of the paddle breaking during use. These ribs also act as a support for the projection and provide strength and stiffness along the length of the paddle.

By "longitudinal" it is meant the direction of greatest length of the tool of the invention i.e. from the handle portion to the paddle portion. By "transverse" it is meant the direction of the width going across the tool of the invention i.e. between the two rods. By "underside" or "lower side" of the tool it is meant the side of the tool which is remote from the user's skin whilst the tool is being used to remove the garment, whilst "upper side" refers to the side which is adjacent the user's skin in use of the tool.

BRIEF DESCRIPTION OF THE DRAWINGS

The invention will be more clearly understood from the following description of an embodiment thereof, given by way of example only, with reference to the accompanying drawings.

DETAILED DESCRIPTION OF THE DRAWINGS

Figure 1:
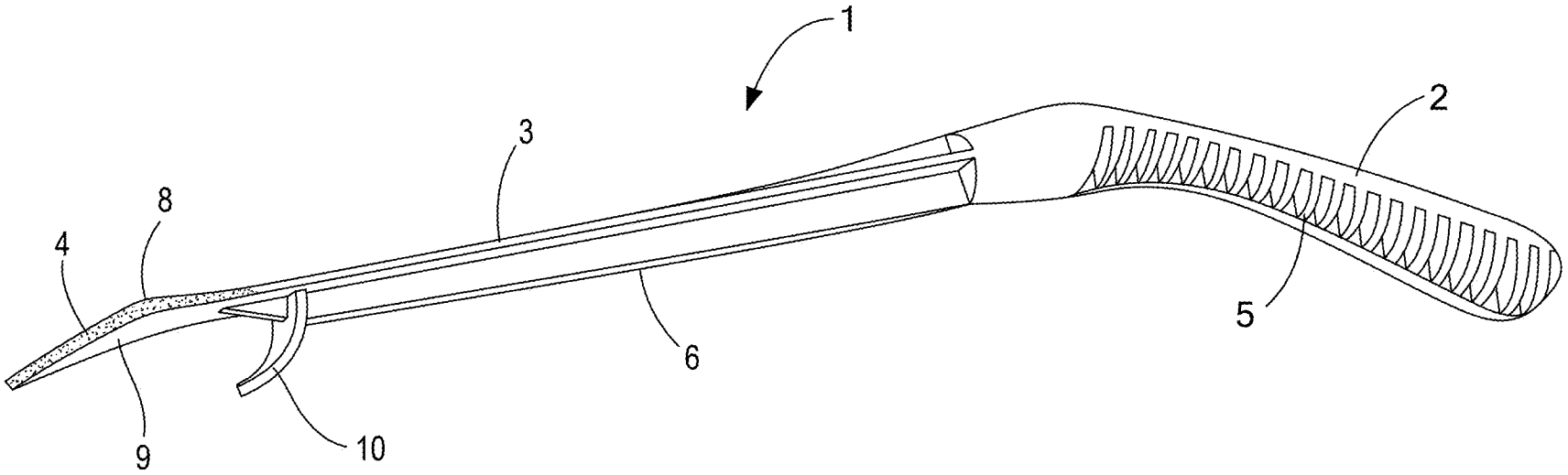
FIG. 1 is a perspective view of a first embodiment of the remover tool of the invention with a single fin.
Figure 2:
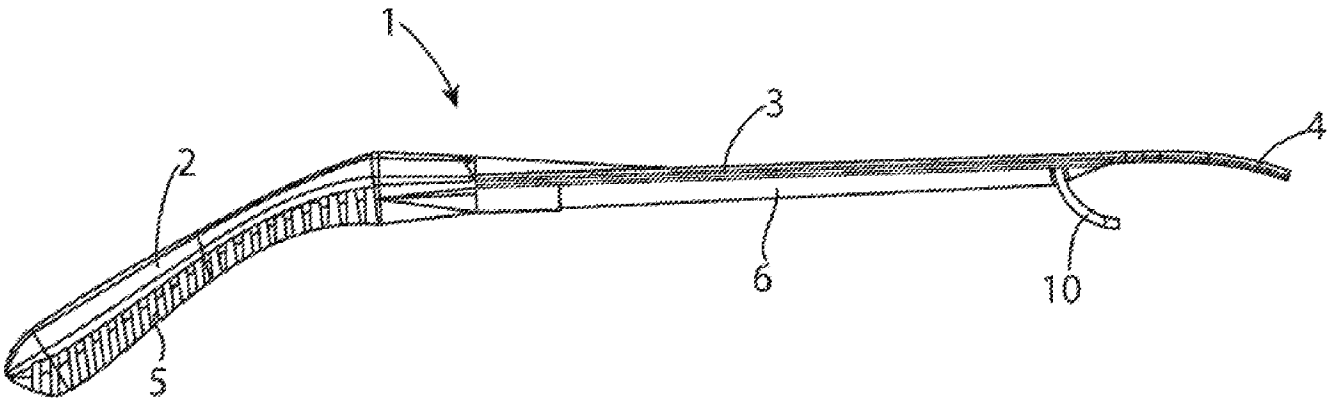
FIG. 2 is a side view of the first embodiment of the remover tool of the invention with fins, showing the strengthening ribs.

As shown in FIG. 1, the tool (1) comprises a hand gripping portion (2) at one end, the hand gripping portion or handle (2) being connected to an elongate tongue member (3) which terminates at the other end in a paddle like structure (4). The tool (1) has a longitudinal dimension and a transverse dimension. The handle (2) is formed with a plurality of ridges and indentations (5) to make gripping the handle easier.

The elongate tongue member (3) and the paddle shaped portion (4) are formed with a convex upper side (8) and a concave lower side (9). The lower surface of the elongate tongue member (3) is provided with a fin (10), the free end of which projects from the lower surface and curves towards the paddle shaped portion (4). The convex side of the tongue member (3) and the paddle shaped portion (4) is formed with a textured surface. The concave side of the tongue member (3) is formed with a series of strengthening ribs (6).

Suitably, the removal tool of the invention may be made entirely from a material selected from any hard, strong, durable material, for example, plastics, hard woods, engineered wood ply, nylon, stainless steel and combinations thereof. The material should be flexible. The material is preferably rust-resistant. Stainless steel is a particularly preferred material of construction. Also other metals, coated in stainless steel may be used. Various components of the tool can be made from any of these materials alone or in combination. Suitably the tongue and hand-gripping portion are made of a plastics material and the rods of stainless steel.

During removal of the garment from the leg, the tool (1) is inserted between the leg and the garment at the back of the knee. As the user pushes down with the tool (1), it glides along the leg contours and the tongue (3) and the paddle (4) slide down the leg. Because the paddle (4) end of the tongue (3) is flexible and curved it doesn't catch on the heel of the user and allows the garment to easily be pulled around the heel. As the tool (1) is moved down the leg, the garment is gathered up by the fin (10) and as the tool (1) moves downward, the fabric gathered and restrained by the fin (10) is pushed down the leg.

The removal tool of the invention provides for more than just levering the garment away from the skin. It allows three functions in one action. At one end, the tool has a fin assembly (10) projecting downwards from its (concave) underside which serves to gather the garment as it is pushed down the leg. As the fins (10) push the garment down the wearer's leg, the tool maintains separation of the garment from the skin and it glides over the heel, removing the garment with ease.

The length of the tool is not critical, however a longer length helps the user not to have to bend down so much, and so the longer length is particularly suitable for an elderly or infirm user.

The words "comprises/comprising" and the words "having/including" when used herein with reference to the present invention are used to specify the presence of stated features, integers, steps or components but does not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

I claim:

1. A garment removal tool for facilitating removal of an article of clothing from the lower limbs, ankle, and feet of a wearer's body, the garment removal tool comprising:

an elongate body having a longitudinal length and a transverse length;

the elongate body further having a first end and a second end opposite the first end;

the first end of the elongate body having a gripping portion;

the elongate body further having a tongue connected to the gripping portion, the tongue terminating at the second end of the elongate body in a paddle shaped portion;

the paddle shaped portion of the tongue being flexible;

the paddle shaped portion of the tongue having an upper side and a lower side opposite the upper side, the upper side of the paddle shaped portion of the tongue having a rough textured surface; and a fin having a free end, the fin being disposed proximate the paddle shaped portion of the tongue, the fin projecting downwardly from the tongue and curving toward the second end of the elongate body;

wherein when the garment removal tool is oriented such that (i) the lower side of the paddle shaped portion of the tongue faces downwardly and (ii) the fin projects downwardly from the tongue and curves toward the second end of the elongate body, the upper side of the paddle shaped portion of the tongue faces upwardly.

2. The garment removal tool of claim 1, wherein the rough textured surface of the upper side of the paddle shaped portion of the tongue is a bead blasted surface.

3. The garment removal tool of claim 1, wherein the paddle shaped portion of the tongue has a portion that broadens out with respect to the remainder of the paddle shaped portion of the tongue.

4. The garment removal tool of claim 1, wherein the upper side of the paddle shaped portion of the tongue is convex, and wherein the lower side of the paddle shaped portion of the tongue is concave.

5. The garment removal tool of claim 1, wherein the tongue of the elongate body further has a plurality of strengthening ribs extending along the longitudinal length of the elongate body to increase the bending strength of the garment removal tool.

6. The garment removal tool of claim 1, wherein the paddle shaped portion of the tongue of the elongate body has a rounded edge.

7. The garment removal tool of claim 1, wherein the gripping portion of the first end of the elongate body has at least one from the group consisting of finger grooves, indentations, and positioning areas.

8. The garment removal tool of claim 1, wherein the rough textured surface of the upper side of the paddle shaped portion of the tongue is a tumbled surface.

9. The garment removal tool of claim 1, wherein the rough textured surface of the upper side of the paddle shaped portion of the tongue is a textured paint.

10. The garment removal tool of claim 1, wherein the paddle shaped portion of the tongue of the elongate body has a filleted edge.

11. The garment removal tool of claim 1, wherein the tongue of the elongate body further has a strengthened portion extending between the gripping portion of the first end of the elongate body and the paddle shaped portion of the tongue, and wherein the strengthened portion of the tongue is stiffer than the paddle shaped portion of the tongue.

12. The garment removal tool of claim 11, wherein the strengthened portion of the tongue of the elongate body has at least one strengthening rib extending along the longitudinal length of the elongate body that stiffens at least the strengthened portion of the tongue.

13. The garment removal tool of claim 11, wherein the strengthened portion of the tongue of the elongate body defines a first plane along the longitudinal length of the elongate body, wherein the paddle shaped portion of the tongue of the elongate body defines a second plane, and wherein the second plane intersects with the first plane to form an angle between the second plane and the first plane.

14. The garment removal tool of claim 13, wherein the angle is between 4 to 10 degrees.

15. The garment removal tool of claim 14, wherein the angle is 6.5 degrees.

16. The garment removal tool of claim 1, wherein the rough textured surface of the upper side of the paddle shaped portion of the tongue has a roughness of between 12-230 Ra micrometres.

17. A garment removal tool for facilitating removal of an article of clothing from the lower limbs, ankle, and feet of a wearer's body, the garment removal tool comprising:

an elongate body having a longitudinal length and a transverse length;

the elongate body further having a first end and a second end opposite the first end;

the first end of the elongate body having a gripping portion;

the elongate body further having a tongue connected to the gripping portion, the tongue terminating at the second end of the elongate body in a paddle shaped portion;

the paddle shaped portion of the tongue being flexible;

the tongue further having a strengthened portion extending between the gripping portion of the first end of the elongate body and the paddle shaped portion of the tongue;

the strengthened portion of the tongue being stiffer than the paddle shaped portion of the tongue;

the paddle shaped portion of the tongue having a convex upper side and a concave lower side opposite the convex upper side, the convex upper side of the paddle shaped portion of the tongue having a textured surface, wherein the textured surface has a roughness of between 12-230 Ra micrometres;

wherein when the garment removal tool is oriented such that the concave lower side of the paddle shaped portion of the tongue faces downwardly, the convex upper side of the paddle shaped portion of the tongue faces upwardly.

18. The garment removal tool of claim 17, wherein the strengthened portion of the tongue of the elongate body has at least one strengthening rib extending along the longitudinal length of the elongate body that stiffens at least the strengthened portion of the tongue.

19. A garment removal tool for facilitating removal of an article of clothing from the lower limbs, ankle, and feet of a wearer's body, the garment removal tool comprising:

an elongate body having a longitudinal length and a transverse length;

the elongate body further having a first end and a second end opposite the first end;

the first end of the elongate body having a gripping portion;

the elongate body further having a tongue connected to the gripping portion, the tongue terminating at the second end of the elongate body in a paddle shaped portion;

the paddle shaped portion of the tongue being flexible;

the tongue further having a strengthened portion extending between the gripping portion of the first end of the elongate body and the paddle shaped portion of the tongue;

the strengthened portion of the tongue being stiffer than the paddle shaped portion of the tongue;

the paddle shaped portion of the tongue having a convex upper side and a concave lower side opposite the convex upper side, the convex upper side of the paddle shaped portion of the tongue having a textured surface, wherein the textured surface has a roughness of between 12-230 Ra micrometres; and a fin having a free end, the fin being disposed proximate the paddle shaped portion of the tongue, the fin projecting downwardly from the tongue and curving toward the second end of the elongate body;

wherein when the garment removal tool is oriented such that (i) the concave lower side of the paddle shaped portion of the tongue faces downwardly and (ii) the fin projects downwardly from the tongue and curves toward the second end of the elongate body, the convex upper side of the paddle shaped portion of the tongue faces upwardly.

20. The garment removal tool of claim 19, wherein the strengthened portion of the tongue of the elongate body has at least one strengthening rib extending along the longitudinal length of the elongate body that stiffens at least the strengthened portion of the tongue.

* * * * *